US007350657B2

(12) United States Patent
Eaton et al.

(10) Patent No.: US 7,350,657 B2
(45) Date of Patent: Apr. 1, 2008

(54) GRIP FOR BEVERAGE CONTAINER

(75) Inventors: John A. Eaton, Sandy Hook, CT (US); William R. Eaton, Milford, CT (US); Erica S. Nozato, Ridgefield, CT (US)

(73) Assignee: Mott's LLP, Stamford, CT (US)

( * ) Notice: Subject to any disclaimer, the term of this patent is extended or adjusted under 35 U.S.C. 154(b) by 332 days.

(21) Appl. No.: 10/809,139

(22) Filed: Mar. 25, 2004

(65) Prior Publication Data

US 2005/0211662 A1 Sep. 29, 2005

(51) Int. Cl.
*B65D 23/10* (2006.01)

(52) U.S. Cl. ..... 215/384; 215/373; 215/398; 220/675; 220/771

(58) Field of Classification Search ..... 215/383, 215/384, 398, 373, 397; 220/669, 675, 771
See application file for complete search history.

(56) References Cited

U.S. PATENT DOCUMENTS

| | | | | | |
|---|---|---|---|---|---|
| 1,602,391 | A | * | 10/1926 | Creaver | 215/384 |
| 2,802,499 | A | * | 8/1957 | Tupper | 366/347 |
| 2,959,441 | A | * | 11/1960 | Lindstrom | 294/29 |
| 3,152,710 | A | * | 10/1964 | Platte | 215/384 |
| 3,198,377 | A | * | 8/1965 | Buckley | 220/771 |
| 3,225,950 | A | * | 12/1965 | Fulcher et al. | 215/384 |
| 3,308,997 | A | * | 3/1967 | Kelly | 222/475 |
| 3,708,082 | A | * | 1/1973 | Platte | 215/385 |
| D250,574 | S | * | 12/1978 | Boyle | D9/537 |
| D259,021 | S | * | 4/1981 | Khovaylo et al. | D9/539 |
| 4,781,314 | A | * | 11/1988 | Schoonover et al. | 222/465.1 |
| 4,885,809 | A | * | 12/1989 | Muchmore | 4/259 |
| 4,923,098 | A | * | 5/1990 | Schoonover et al. | 222/465.1 |
| 5,052,567 | A | * | 10/1991 | Colani | 215/384 |
| 5,101,990 | A | * | 4/1992 | Krishnakumar et al. | 215/383 |
| 5,158,190 | A | * | 10/1992 | Sosenko | 215/384 |
| D349,045 | S | * | 7/1994 | Schmitt | D9/692 |
| 5,423,452 | A | * | 6/1995 | Tardif | 220/574 |
| 5,435,451 | A | * | 7/1995 | Dyer | 215/400 |
| D379,763 | S | | 6/1997 | Ewing, Jr. | D9/520 |
| D393,210 | S | | 4/1998 | Ewing, Jr. | D9/543 |
| 5,758,790 | A | | 6/1998 | Ewing, Jr. | 215/384 |
| 5,806,709 | A | * | 9/1998 | Marshall, II | 220/755 |
| 5,862,929 | A | * | 1/1999 | Takeuchi et al. | 215/398 |
| 5,908,127 | A | * | 6/1999 | Weick et al. | 215/373 |
| 5,927,533 | A | * | 7/1999 | Payne et al. | 215/384 |

(Continued)

FOREIGN PATENT DOCUMENTS

| | | | |
|---|---|---|---|
| WO | WO 92/12901 | * | 8/1992 |

*Primary Examiner*—Sue A. Weaver
(74) *Attorney, Agent, or Firm*—Cox Smith Matthews Incorporated

(57) ABSTRACT

A beverage container with a grip formed in side and bottom walls thereof. The grip includes a V-shaped groove on a side wall that receives a finger of a consumer (e.g., a thumb or set of fingers) and a recess formed in a bottom wall of the container to receive one or more other fingers of the consumer's hand. When gripped in this fashion a lower corner of the bottle may be located in the palm of the consumer's hand. The groove in the side wall is formed in the side wall sufficiently close to the bottom wall to allow the hands of most consumers to use the grip. The V shape points upward. Either side of the V can be used depending on whether the consumer wishes to grip with their right hand or their left hand.

29 Claims, 6 Drawing Sheets

U.S. PATENT DOCUMENTS

| | | | | |
|---|---|---|---|---|
| D433,947 | S | 11/2000 | Ewing, Jr. | D9/543 |
| 6,173,850 | B1 * | 1/2001 | Scheetz et al. | 215/11.1 |
| 6,237,792 | B1 * | 5/2001 | Skolnicki et al. | 215/382 |
| D450,590 | S * | 11/2001 | Van Dyk et al. | D9/502 |
| 6,398,052 | B1 * | 6/2002 | Cheng et al. | 215/384 |
| 6,554,154 | B1 * | 4/2003 | Chauhan et al. | 220/671 |
| 6,695,163 | B2 * | 2/2004 | Michalowski | 215/398 |
| 6,948,333 | B1 * | 9/2005 | Akopyan | 62/457.3 |
| 2004/0000533 | A1 * | 1/2004 | Kamineni et al. | 215/373 |
| 2005/0205512 | A1 * | 9/2005 | Scarrott et al. | 215/230 |

* cited by examiner

GRIP FOR BEVERAGE CONTAINER

This invention relates generally to beverage containers, and more particularly to grips for beverage containers.

BACKGROUND

Gallon sized containers are popular for the retail sale of flavored beverages to consumers. Some of these beverages may be hot-filled into the containers in the case of 100% pure juices, for example, while other beverages may be cold-filled into the containers. The containers are typically made of plastic, and may be manufactured via injection molding, blow molding, or some other suitable method.

There are several design criteria for such containers. First of all, because of the size of the container and the significant weight of the container when filled to capacity with liquid, the containers typically include a handle or grip for ease of use by the consumer. It is also preferable to have a gallon size bottle be as volumetrically small as possible (occupy the least amount of shelf space), as this may be preferred by store owners and consumers. Another important consideration is that producers, distributors, and sellers of these products prefer to palletize many containers onto a single pallet, including stacking the bottles vertically on top of each other several layers high.

Pass-through handles are popular, but they do have some disadvantages. First of all, it is difficult to produce bottles with pass-through handles via blow molding techniques. Second, depending on the size and type of the pass-through handle, it can increase the width or height of the one gallon bottle.

Some blow-molded bottles have a pair of opposed features notched out of the side of the bottle to produce what is known as a pinch grip, which is grasped by the consumer with a thumb in one feature and fingers in the opposing feature. These pinch grips can work well, but depending on their size and type, they can reduce the top-load strength and increase the height and width of the one gallon bottle.

Another type of handle which is popular is a separate bail handle that is attached to the opening of the bottle. Bail handles, when used alone, are generally used to transport product rather than pour product out. Bail handles are typically located at the bottom of the neck finish of a bottle and are too high on the bottle, and too far away from the center of gravity to be used to pour product alone. Bail handles must be used with a second grip feature of some kind in order to be used as a pouring mechanism.

It is against this background and with a desire to improve on the prior art that a grip for a beverage container has been developed.

SUMMARY

A beverage container is provided that includes a bottom wall and a side wall attached to the bottom wall. The side wall defines an opening on an upper portion thereof. The side wall has a groove formed in an outer surface thereof to receive one or more fingers of a hand of a user when the user is pouring liquid out of the container. The groove has a portion that is sloped to run from a position that is relatively closer to the bottom wall to a position that is relatively further from the bottom wall. The bottom and side walls are formed to contain liquids within the container, the liquids being provided to and removed from the container via the opening.

The bottom wall may have a recessed portion formed therein to receive one or more other fingers of the hand of the user when the user is pouring liquid out of the container. The user may place their thumb in the groove and one or more of the other fingers on their hand in the recess. The groove may have two portions that are sloped to run from a position that is relatively closer to the bottom wall to a position that is relatively further from the bottom wall. The two portions may be sloped in opposite directions. The two portions together may form a V shape. The V shape may point away from the bottom wall.

The side wall may include four faces that each extend from the bottom wall up toward the opening, with the groove formed in a single one of the faces. Each of the faces may be slightly curved with respect to a longitudinal axis and the faces join to adjacent faces at rounded edges. A bottom corner of the container may be formed by the conjunction of the bottom wall and any two of the faces, and the bottom and side walls and the groove may be configured to allow a user to grasp each of the groove and at least a portion of the bottom wall to allow the user to pour liquid out of the container while holding one of the bottom corners of the container. The user may hold the bottom corner of the container in the palm of their hand.

Another aspect of the beverage container relates to a container with a bottom wall and a side wall attached to the bottom wall. The side wall defines an opening on an upper portion thereof, with the side wall including at least three faces that each extend from the bottom wall up toward the opening. The side wall has a gripping portion formed in an outer surface of one of the faces to receive one or more fingers of a hand of a user when the user is pouring liquid out of the container. A bottom corner of the container is formed by the conjunction of the bottom wall and any two of the faces. The bottom wall and side walls are formed to contain liquids within the container, the liquids being provided to and removed from the container via the opening. The bottom and side walls and the gripping portion on the face of the side wall are configured to allow a user to grasp each of the gripping portion and at least a portion of the bottom wall to allow the user to pour liquid out of the container while holding one of the bottom corners of the container.

The gripping portion on the side wall may include a groove having a portion that is sloped to run from a position that is relatively closer to the bottom wall to a position that is relatively further from the bottom wall.

Numerous additional features and advantages of the present invention will become apparent to those skilled in the art upon consideration of the further description that follows.

DETAILED DESCRIPTION

Reference will now be made to the accompanying drawings, which assist in illustrating the various pertinent features of the beverage container. Although the invention will now be described primarily in conjunction with beverage containers, it should be expressly understood that the invention may be applicable to other applications where grips for objects are required/desired. In this regard, the following description of a beverage container is presented for purposes of illustration and description. Furthermore, the description is not intended to limit the invention to the form disclosed herein. Consequently, variations and modifications commensurate with the following teachings, and skill and knowledge of the relevant art, are within the scope of the packaging design. The embodiments described herein are further intended to explain modes known of practicing the invention and to enable others skilled in the art to utilize the invention in such, or other embodiments and with various modifications required by the particular application(s) or use(s) of the beverage container.

Figure 3:
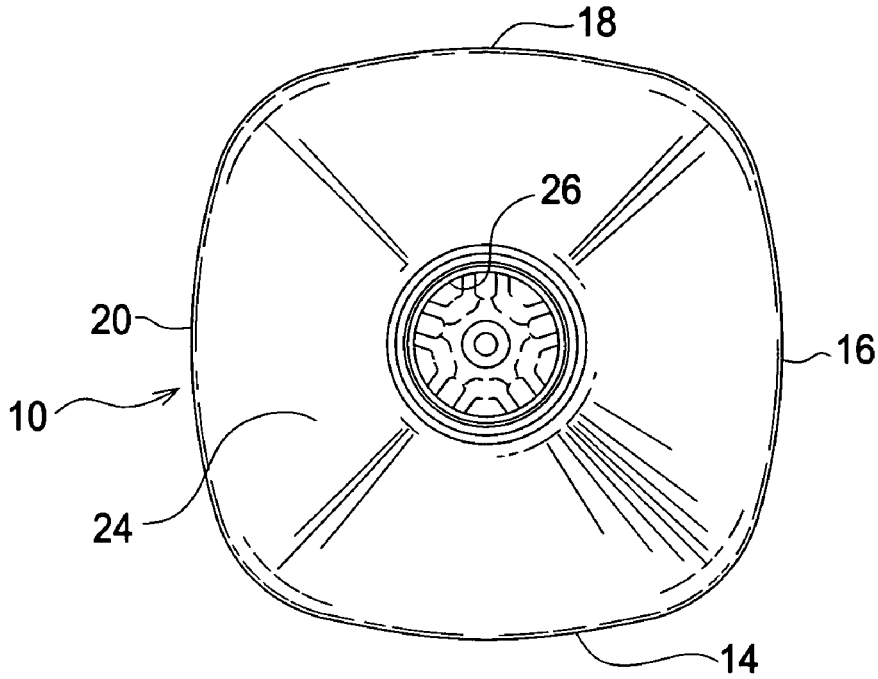
FIG. 3 is a top plan view of the container of FIG. 1.
Figure 4:
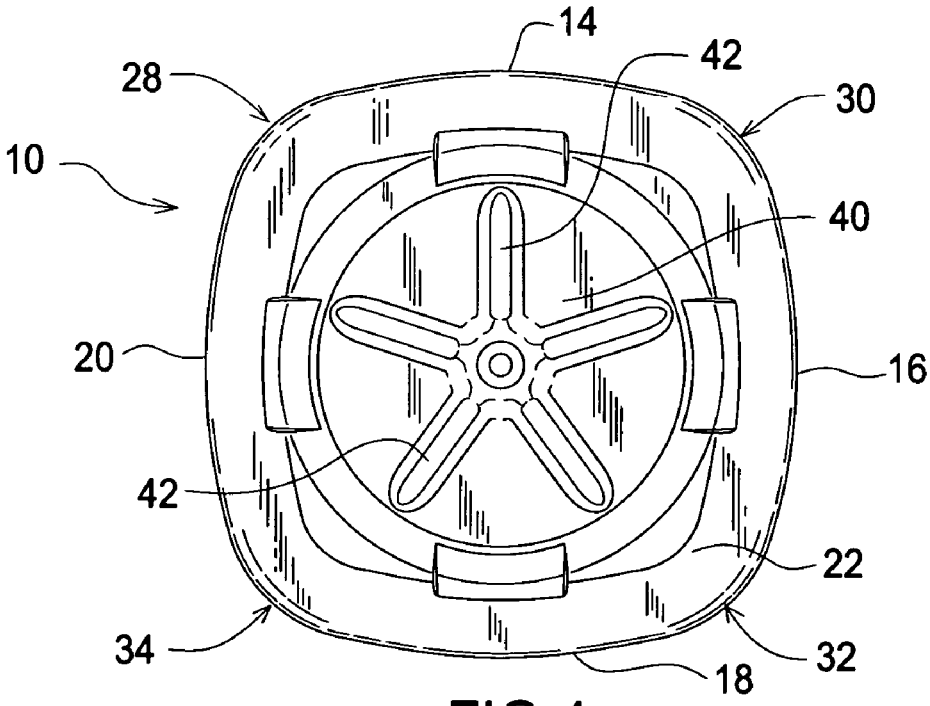
FIG. 4 is a bottom plan view of the container of FIG. 1.
Figure 6:
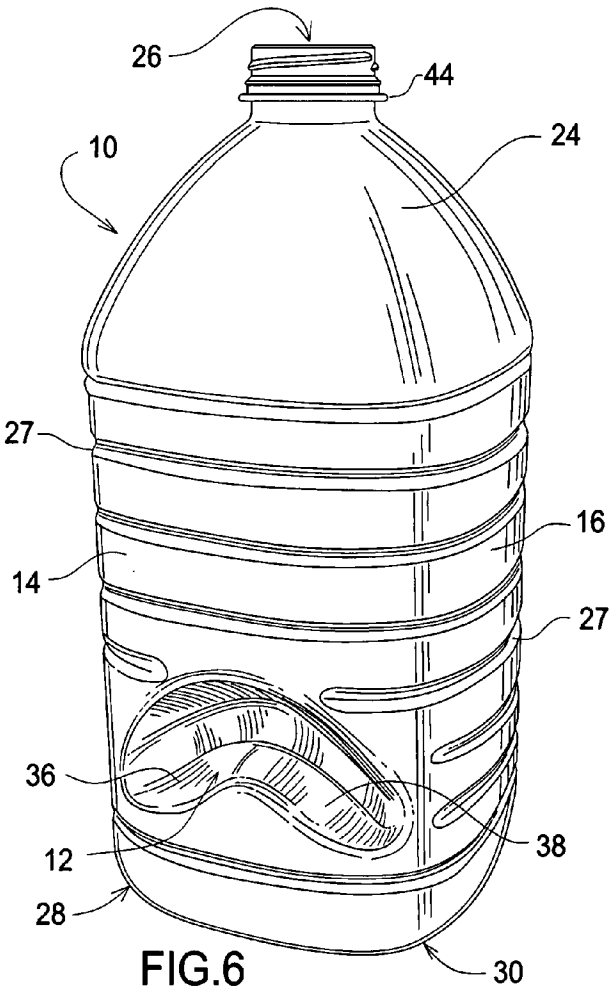
FIG. 6 is a perspective view of the container of FIG. 1.
Figure 5:
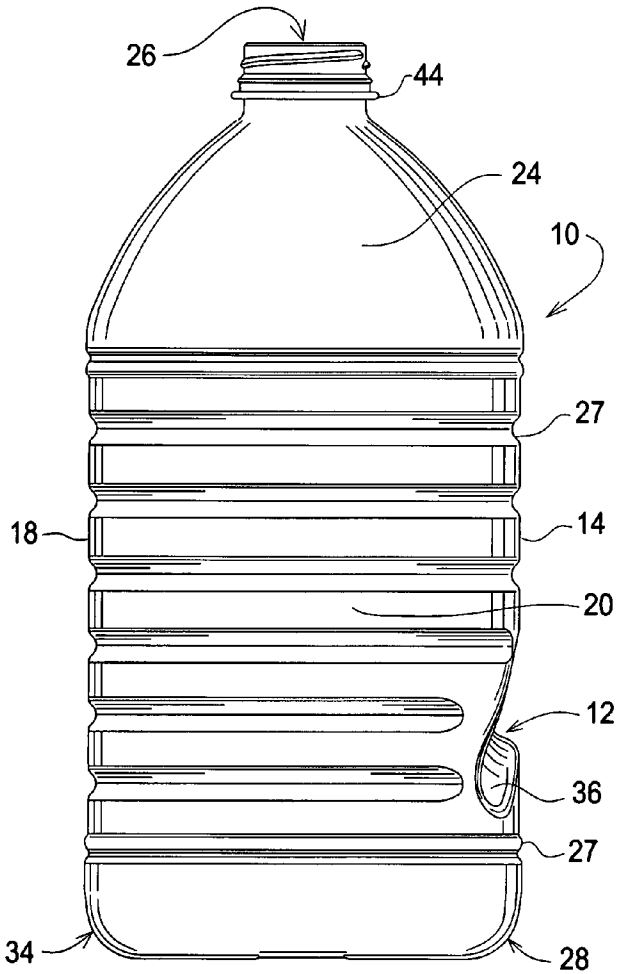
FIG. 5 is a side elevation view of a left side of the container of FIG. 1.

A bottle 10 includes an inverted V- or chevron-shaped groove 12 formed in a side wall 14 thereof. The bottle 10 could be any of a variety of different types and shapes of bottles. For illustrative purposes only, the bottle 10 described herein may be a blow-molded plastic bottle having a one-gallon capacity. As can be seen in FIGS. 3, 4, and 6, the bottle 10 may be a generally square bottle with four slightly curved side walls 14, 16, 18, and 20 that meet at rounded edges. On a bottom side of the bottle 10 is a bottom wall 22 that joins each of the side walls 14, 16, 18, and 20. Located on an upper side of the bottle 10 is a crown 24 that joins with each of the side walls 14, 16, 18, and 20. The crown 24 has a cylindrical opening 26 defined at an upper end thereof for pouring liquids into and out of the bottle 10.

Figure 2:
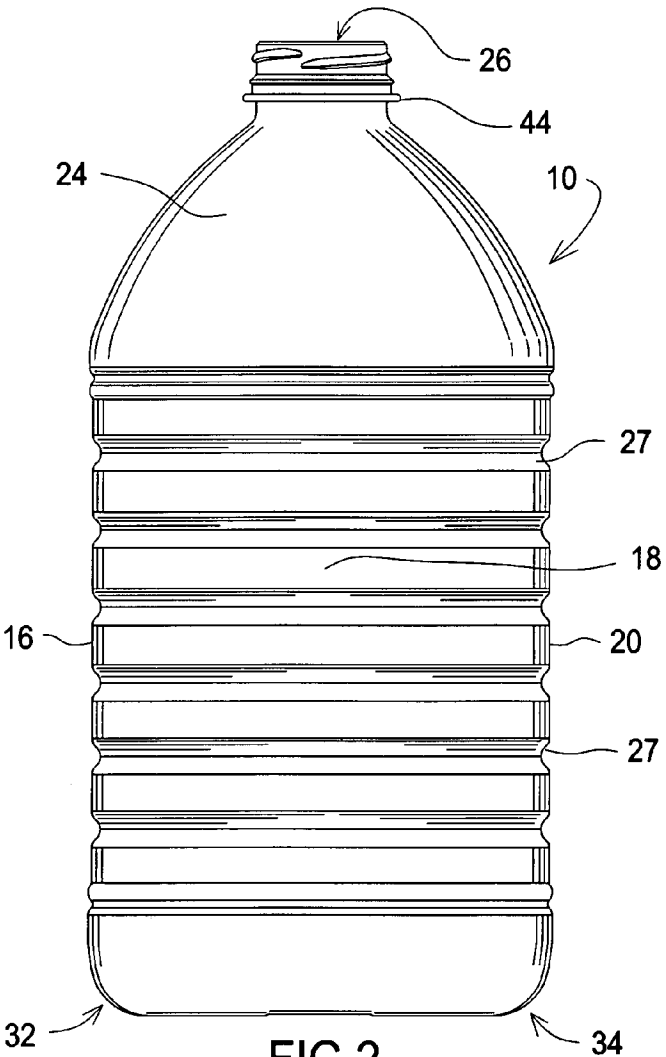
FIG. 2 is a front elevation view of the container of FIG. 1.
Figure 1:
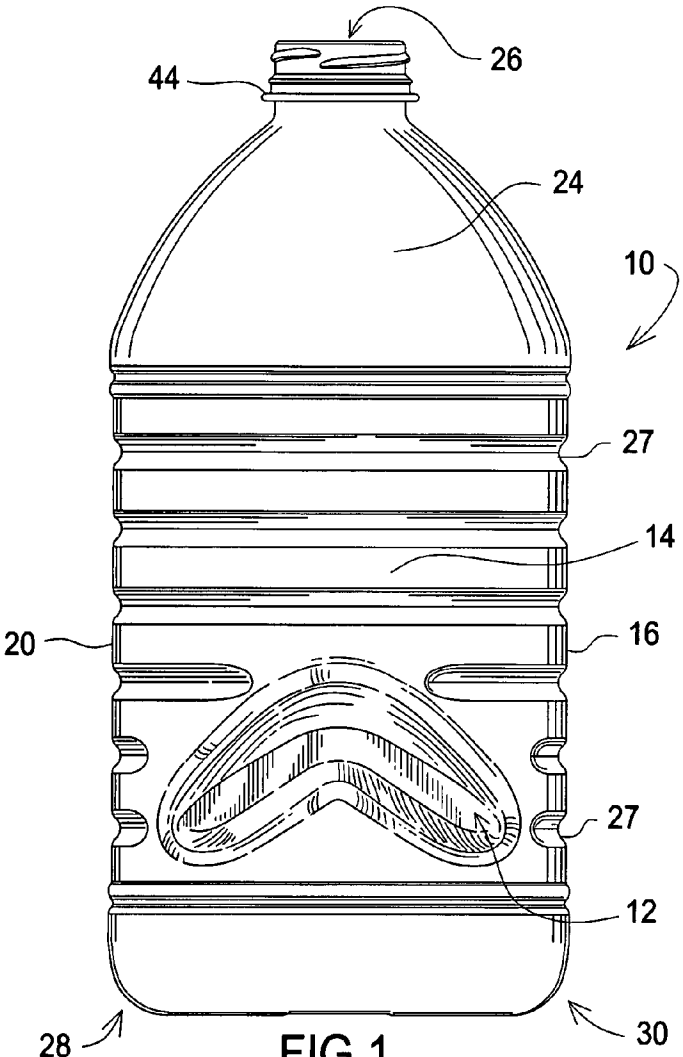
FIG. 1 is a rear elevation view of a beverage container and a recessed grip located thereon.

Each of the side walls 14, 16, 18, and 20 have a plurality of ribs 27 (FIGS. 1, 2, and 6) formed therein to strengthen the bottle 10, in particular increasing the top loading capacity of the bottle 10 by strengthening the side walls 14, 16, 18, and 20. Four corners 28, 30, 32, and 34 are formed, one at each of the conjunctions of a pair of adjacent side walls and the bottom wall 22. The groove 12 is located on the side wall 14 relatively closer to the bottom wall 22 than to the crown 24. As can be seen in FIGS. 1, 5, 6, and 7, the groove includes two sloped portions 36 and 38 that each start near side edges of the side wall 14 and slope slightly upward to where they join together in a central portion of the side wall 14.

Figure 7:
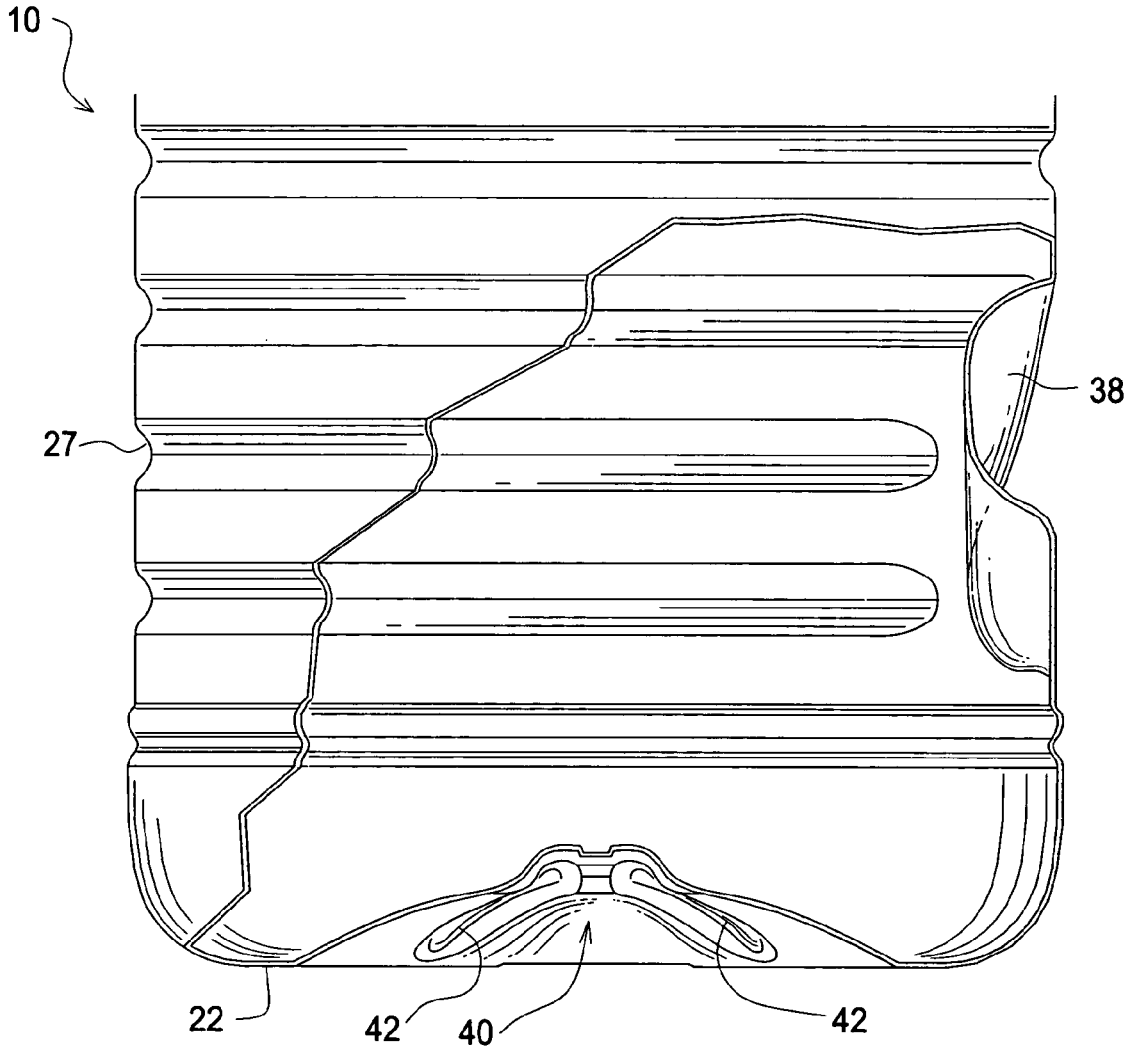
FIG. 7 is a close-up partial sectional side elevation view of the recessed grip of the container of FIG. 1.

As seen best in FIGS. 4 and 7, the bottom wall 22 is domed to define a recess 40 that protrudes slightly toward the interior of the bottle 10. The bottom wall 22 also includes a plurality of radial ribs 42 defined therein for strengthening purposes.

The crown 24 includes surfaces that slope more upward than inward so that the crown 24 is generally more vertically-extending than horizontally-extending. This feature of the crown also increases the top loading capacity of the bottle 10.

Figure 9:
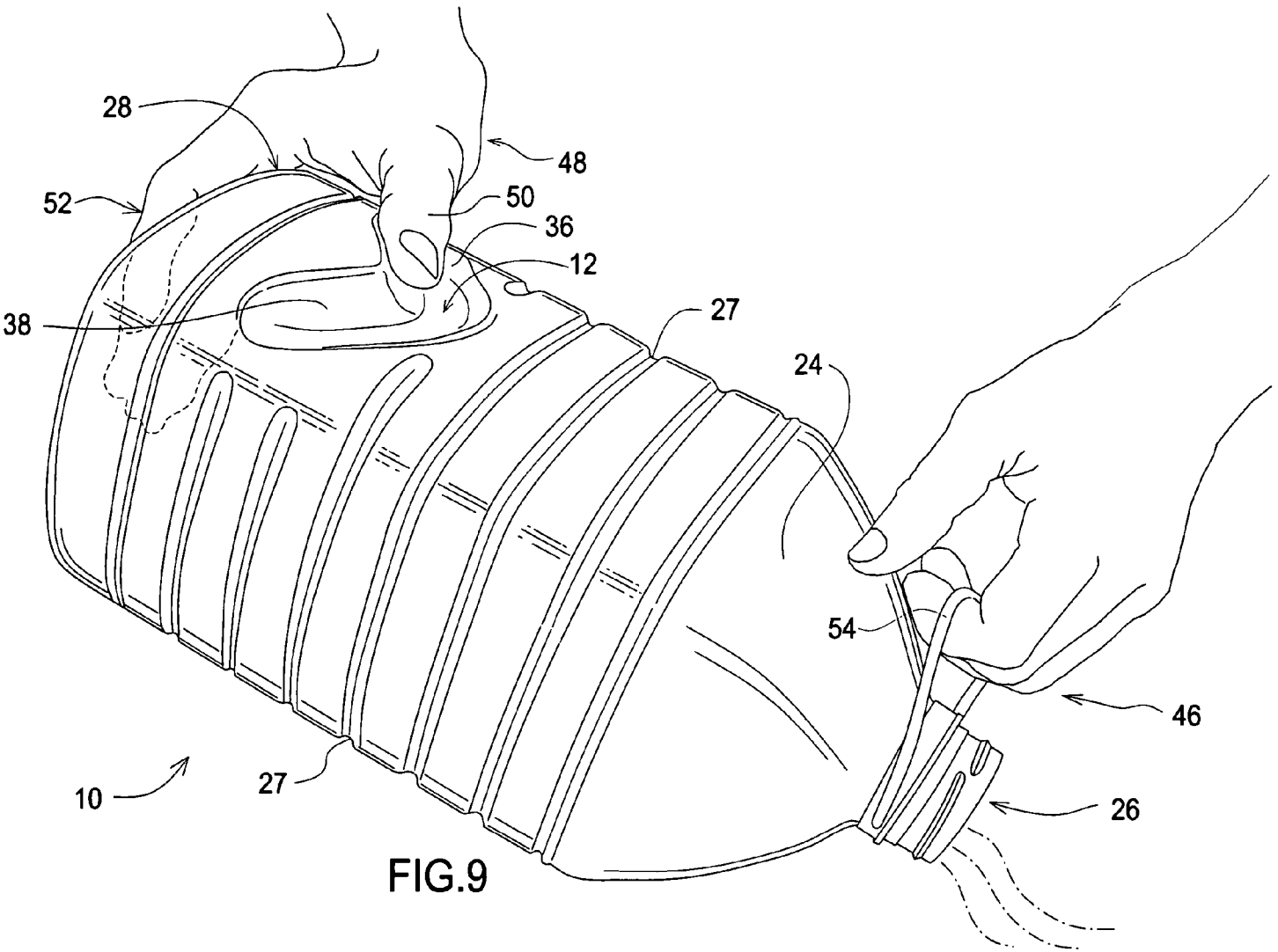
FIG. 9 is a perspective view of the container of FIG. 1 with a bail handle attached thereto being held by two hands of a user while pouring liquid out of the container.

The opening 26 defined at the upper end of the crown 24 is generally smooth and cylindrical on an interior surface thereof and is externally threaded on an exterior surface thereof to receive a mating cap (not shown). Located on the exterior surface of the opening just below the external threads is a lip 44 that may be used to retain a separate bail handle 54 that can be provided for aid in pouring liquid from the bottle 10, as shown in FIG. 9.

Figure 8:
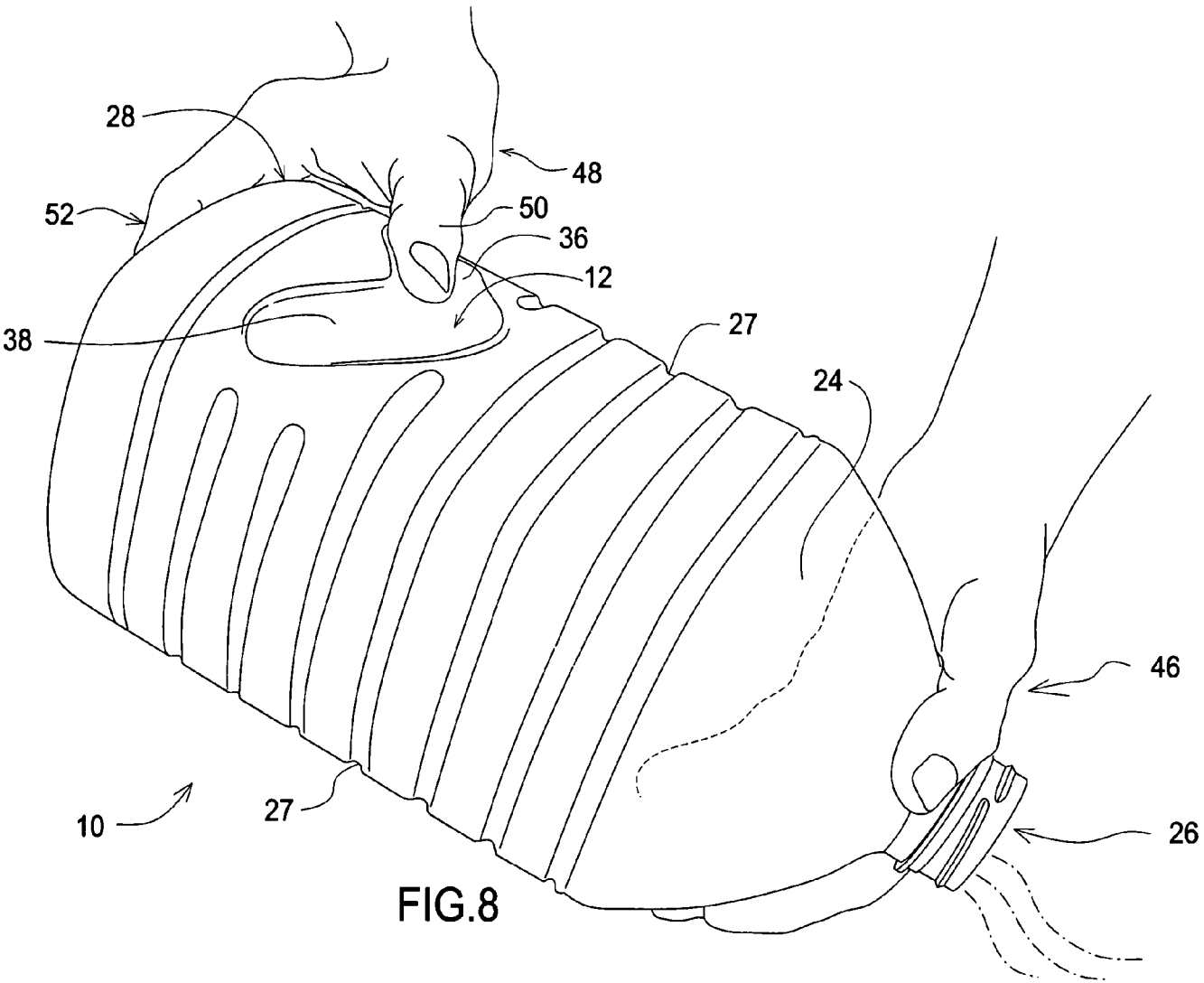
FIG. 8 is a perspective view of the container of FIG. 1 being held by two hands of a user while pouring liquid out of the container.

Alternatively, a consumer can pour liquid out of the bottle 10 by grasping the crown 24 of the bottle 10 with their left hand 46 and grasping the corner 28 of the bottle 10 with their right hand 48. More particularly, as shown in FIG. 8, the consumer can place the thumb 50 of their right hand 48 into one portion 36 of the groove 12 while the corner 28 of the bottle 10 is in the palm of the right hand 48 and one or more fingers 52 of their right hand 48 are placed into the recess 40 of the bottom wall 22. In this manner, the bottle 10 can be controlled quite easily by the consumer while pouring liquid therefrom. Alternatively, a left-handed consumer could place their right hand on the crown 24 of the bottle 10 and their left hand into the opposite portion 38 of the groove 12 while grasping the corner 30 of the bottle 10. Several other alternative gripping arrangements utilizing the groove 12 are also possible. As stated above (and shown in FIG. 9), it is possible to use the bail handle 54 with the upper hand and have the lower hand gripping one of the corners and the groove as already described.

The spacing between the groove 12 and the recess 40 may be such as to fit an optimal number of the hands of adult and older children. One example of such a spacing may be in the range of two to four inches.

As can be appreciated, there are many advantages to the beverage container described herein. One advantage relates to having a gripping feature that allows the consumer to grasp a lower corner 28 of the bottle 10 in the palm of one of their hands. This may be advantageous because it places a controlling hand near the bottom of the bottle 10, which may be closer to the center of gravity as the bottle contains less and less fluids. Prior art handles at the top of the bottle were located further and further from the center of gravity as the bottle was emptied. In addition, the gripping features of the bottle 10 are achieved largely with the groove 12, the corner 28, and the recess 40 without creating features that dramatically intrude into the interior of the bottle 10, which would decrease the volumetric capacity of the bottle. Furthermore, the gripping features of the bottle do little to decrease the top loading strength of the bottle 10. This may be distinguishable from many prior art bottles in which gripping features, particularly those that intruded toward the interior of the bottle, did decrease the top loading strength of the bottle. Not all of these advantages are necessarily found in each of the embodiments.

The foregoing description of the beverage container has been presented for purposes of illustration and description. Furthermore, the description is not intended to limit the invention to the form disclosed herein. For example, it should be appreciated that the exact shape, style, and position of the groove could be varied, as long as a gripping feature is provided that allows the consumer to place the corner of the bottle into the palm of their hand. One particular example might involve the groove being shaped in a fanciful manner such as to resemble a side view of an ocean wave. Consequently, variations and modifications commensurate with the above teachings, and skill and knowledge of the relevant art, are within the scope of the invention. The embodiments described hereinabove are further intended to explain best modes known of practicing the invention and to enable others skilled in the art to utilize the invention in such, or other embodiments and with various modifications required by the particular application(s) or use(s) of the invention. It is intended that the appended claims be construed to include alternative embodiments to the extent permitted by the prior art.

What is claimed is:

1. A bottle, comprising:

a bottom wall, the bottom wall having a recessed portion formed therein to receive one or more fingers of a hand of a user when the user is pouring liquid out of the bottle; and a side wall attached to the bottom wall, the side wall defining an opening on an upper portion thereof, the side wall having a groove formed in an outer surface thereof to receive one or more other fingers of the hand of the user when the user is pouring liquid out of the bottle, the groove having a portion that is sloped to run from a position that is relatively closer to the bottom wall to a position that is relatively further from the bottom wall;

wherein the bottom wall and the side wall are formed to contain liquids within the bottle, the liquids being provided to and removed from the bottle via the opening, wherein the user places their thumb in the groove and one or more of the other fingers on their hand in the recess.

2. A bottle as defined in claim 1, wherein the side wall includes four faces that each extend from the bottom wall up toward the opening, with the groove formed in a single one of the faces.

3. A bottle as defined in claim 2, wherein each of the faces is slightly curved with respect to a longitudinal axis and the faces join to adjacent faces at rounded edges.

4. A bottle as defined in claim 2, wherein a bottom corner of the bottle is formed by the conjunction of the bottom wall and any two of the faces, and wherein the bottom and side walls, the recessed portion and the groove are configured to allow a user to grasp each of the groove and the recessed portion to allow the user to pour liquid out of the bottle while holding one of the bottom corners of the bottle.

5. A bottle as defined in claim 4, wherein the user holds the bottom corner of the bottle in the palm of their hand.

6. A bottle as defined in claim 1, wherein the bottle is substantially too large to allow an average-sized hand to grip opposite sides of the side wall proximate to the bottom wall of the bottle simultaneously.

7. A bottle as defined in claim 1, wherein the side wall extends substantially vertically from the bottom wall to a tapered surface formed between the opening and the vertical portion of the side wall.

8. A bottle as defined in claim 1, wherein the bottle has a central axis and the opening is symmetric about the central axis.

9. A bottle as defined in claim 1, wherein the side wall contains one and only one said groove.

10. A bottle, comprising:

a bottom wall, the bottom wall having a recessed portion formed therein to receive one or more fingers of a hand of a user when the user is pouring liquid out of the bottle; and a side wall attached to the bottom wall, the side wall defining an opening on an upper portion thereof, the side wall having a groove formed in an outer surface thereof to receive one or more other fingers of the hand of the user when the user is pouring liquid out of the bottle, the groove having a portion that is sloped to run from a position that is relatively closer to the bottom wall to a position that is relatively further from the bottom wall;

wherein the bottom wall and the side wall are formed to contain liquids within the bottle, the liquids being provided to and removed from the bottle via the opening, wherein the groove has two portions that are sloped to run from a position that is relatively closer to the bottom wall to a position that is relatively further from the bottom wall.

11. A bottle as defined in claim 10, wherein the two portions are sloped in opposite directions.

12. A bottle as defined in claim 11, wherein the two portions together form a V shape.

13. A bottle as defined in claim 12, wherein the V shape points away from the bottom wall.

14. A beverage container, comprising:

a bottom wall; and a side wall attached to the bottom wall, the side wall defining an opening on an upper portion thereof, wherein the side wall includes at least three faces that each extend from the bottom wall up toward the opening, the side wall having a gripping portion formed in an outer surface of one of the faces to receive one or more fingers of a hand of a user when the user is pouring liquid out of the container, a bottom corner of the container being formed by the conjunction of the bottom wall and any two of the faces;

wherein the bottom wall and the side wall are formed to contain liquids within the container, the liquids being provided to and removed from the container via the opening; and wherein the bottom and side walls and the gripping portion on the face of the side wall are configured to allow a user to grasp each of the gripping portion and at least a portion of the bottom wall with a first hand to allow the user to pour liquid out of the container while holding one of the bottom corners of the container.

15. A container as defined in claim 14, wherein the bottom wall has a recessed portion formed therein to receive one or more other fingers of the hand of the user when the user is pouring liquid out of the container.

16. A container as defined in claim 15, wherein the gripping portion on the side wall includes a groove having a portion that is sloped to run from a position that is relatively closer to the bottom wall to a position that is relatively further from the bottom wall.

17. A container as defined in claim 16, wherein the user places their thumb in the groove and one or more of the other fingers on their hand in the recess.

18. A container as defined in claim 14, wherein the gripping portion on the side wall includes a groove having a portion that is sloped to run from a position that is relatively closer to the bottom wall to a position that is relatively further from the bottom wall.

19. A container as defined in claim 18, wherein the user places their thumb in the groove.

20. A container as defined in claim 18, wherein the groove has two portions that are sloped to run from a position that is relatively closer to the bottom wall to a position that is relatively further from the bottom wall.

21. A container as defined in claim 20, wherein the two portions are sloped in opposite directions.

22. A container as defined in claim 21, wherein the two portions together form a V shape.

23. A container as defined in claim 22, wherein the V shape points away from the bottom wall.

24. A container as defined in claim 14, wherein the side wall includes four faces that each extend from the bottom wall up toward the opening.

25. A container as defined in claim 24, wherein each of the faces is slightly curved with respect to a longitudinal axis and the faces join to adjacent faces at rounded edges.

26. A container as defined in claim 14, wherein the beverage container is configured to be grasped by the user with two hands when pouring liquid out of the container, said second hand grasping the container around the opening.

27. A container as defined in claim 26, wherein said configuration comprises a bail handle around the opening of the container.

28. A bottle, comprising:

a bottom wall, the bottom wall having a recessed portion formed therein to receive one or more fingers of a hand of a user when the user is pouring liquid out of the bottle; and a side wall attached to the bottom wall, the side wall defining an opening on an upper portion thereof, the side wall having a groove formed in an outer surface thereof to receive one or more other fingers of the hand of the user when the user is pouring liquid out of the bottle, the groove having a portion that is sloped to run from a position that is relatively closer to the bottom wall to a position that is relatively further from the bottom wall;

wherein the bottom wall and the side wall are formed to contain liquids within the bottle, the liquids being provided to and removed from the bottle via the opening, wherein the side wall further comprises at least three faces that each extend from the bottom wall up toward the opening, with the groove formed in a single one of the faces.

29. A beverage container, comprising;

a bottom wall containing a recessed area centrally located in the bottom wall, wherein the bottom wall is generally square with rounded corners, wherein furthermore the recessed area is formed therein to receive one or more fingers of a hand of a user when the user is pouring liquid out of the container;

a side wall attached to the bottom wall, the side wall having four faces that each extend vertically from the bottom wall, wherein each face contains a plurality of horizontal ribs, furthermore wherein each face is slightly curved with respect to the central axis of the container and the faces join adjacent faces at rounded edges;

a top opening wherein said opening is circular and is externally threaded; and a transitional wall between the opening and the side wall wherein the transitional wall connects the circular opening to the generally square with rounded corners formed by the top of the side wall, wherein the transitional wall is generally domed shape with the opening at the top;

wherein the container contains four bottom corners wherein each bottom corner is rounded and is formed by the conjunction of the bottom wall and two of the faces;

wherein a single face of said side wall having four faces includes a groove formed in the outer surface thereof to receive one or more other fingers up the hand of the user when the user is pouring liquid out of the container, the groove having two portions sloped to run from a position that is relatively closer to the bottom wall to a position that is relatively further from the bottom wall, wherein the two portions are sloped in opposite directions and together form a V shape that points away from the bottom wall; and wherein the bottom wall, the side wall and the transitional wall are formed to contain liquids within the container, the liquids being provided to and removed from the container via the opening.

* * * * *